US012685921B2

(12) United States Patent
Qiao

(10) Patent No.: US 12,685,921 B2
(45) Date of Patent: Jul. 21, 2026

(54) INTEGRATED RAIL FOR POOL TABLE

(71) Applicant: Bing Qiao, Qinhuangdao (CN)

(72) Inventor: Bing Qiao, Qinhuangdao (CN)

( * ) Notice: Subject to any disclaimer, the term of this patent is extended or adjusted under 35 U.S.C. 154(b) by 209 days.

(21) Appl. No.: 18/798,729

(22) Filed: Aug. 8, 2024

(65) Prior Publication Data

US 2024/0408478 A1 Dec. 12, 2024

Related U.S. Application Data

(63) Continuation of application No. PCT/CN2024/073985, filed on Jan. 25, 2024.

(30) Foreign Application Priority Data

Feb. 24, 2023 (CN) ..... 202310163636.7

(51) Int. Cl.
*A63D 15/06* (2006.01)

(52) U.S. Cl.
CPC ..... *A63D 15/06* (2013.01)

(58) Field of Classification Search
CPC ..... A63D 15/06
See application file for complete search history.

(56) References Cited

U.S. PATENT DOCUMENTS

| | | | | |
|---|---|---|---|---|
| 4,531,732 | A * | 7/1985 | Harris | A63D 15/006 473/49 |
| 4,900,021 | A * | 2/1990 | Lalick | A63D 15/00 473/28 |
| 5,131,664 | A * | 7/1992 | Medina | A63D 15/00 473/29 |
| 2005/0282644 | A1 | 12/2005 | Tarbell | |
| 2007/0275785 | A1 | 11/2007 | Cartwright | |
| 2008/0058111 | A1 | 3/2008 | Meyers et al. | |
| 2024/0342584 | A1* | 10/2024 | Qiao | A63D 15/06 |
| 2025/0186870 | A1* | 6/2025 | Qiao | A63D 15/00 |

FOREIGN PATENT DOCUMENTS

CN 204798809 U * 11/2015

* cited by examiner

*Primary Examiner* — Howard D Brown, Jr.

(57) ABSTRACT

An integrated rail for a pool table, including a block A, a block B and a block C integrally formed. The block B is arranged at an inner side of the block C. A bottom surface of the block B is located higher than a bottom surface of the block C in a vertical direction, such that the bottom surface of the block B is connected to an inner side of the block C to form a mounting surface fitting the edge of the playing field. A top surface of the block C and a top surface of the block B are both horizontal and at the same height. The block A is arranged on a top of the block B, and an outer end of the block A extends horizontally outward. A handrail is provided on a top of the block C.

32 Claims, 7 Drawing Sheets

INTEGRATED RAIL FOR POOL TABLE

CROSS-REFERENCE TO RELATED APPLICATIONS

The present disclosure is a continuation-application of International (PCT) Patent Application No. PCT/CN2024/073985, filed on Jan. 25, 2024, which claims priority of Chinese Patent Application No. 202310163636.7, filed on Feb. 24, 2023, the entire contents of which are hereby incorporated by reference in their entirety.

TECHNICAL FIELD

This application relates to pool tables, and more particularly to an integrated rail for a pool table.

BACKGROUND

The existing pool table basically consists of a playing field, a table edge and multiple legs. The legs are configured to support a bottom of the playing field, and the rails are fixedly arranged around the playing field to form an edge structure for billiard balls to hit. The playing field is composed of a slate and a table cloth laid thereon.

As shown in FIG. 1, the existing rail structure includes a rubber strip I2, a steel plate 4, a lower-lining wooden strip 10, a back-lining wooden strip 11 and a wooden handrail 5. The back-lining wooden strip 11 is fixedly connected to an inner side of the steel plate 4 through a screw 12, and the wooden handrail 5 is fixedly connected to an outer side of the steel plate 4 through another screw 6. The steel plate 4 is fixedly arranged on a side of a slate 7 of the playing field through a bolt 9 and a nut 8, and is connected as a whole. An inner periphery of the rail is covered with a table cloth 1. A first end of the table cloth 1 is pressed into a groove on an outer side of the steel plate 4 through a pressing strip 3, and a second end of the table cloth 1 is pressed between the slate 7 and the back-lining wooden strip 11. The steel plate 4, the lower-lining wooden strip 10, the back-lining wooden strip 11 and the wooden handrail 5 constitute a main structure of the above rail.

The existing rail (hereinafter referred to as "steel rail") mainly has the following defects. (1) During the production process of the steel rail, the steel plate 4, the lower-lining wooden strip 10, the back-lining wooden strip 11 and the wooden handrail 5 need to be produced separately, and assembled, which leads to large consumption of labor, material resources and time, resulting in high production cost, long production cycle and low assembly efficiency. (2) The existing steel rail is a steel-wood composite structure, and the Young's elastic modulus of the wooden plate is much smaller than that of the steel plate, such that the stress is concentrated in the steel plate area (namely, uneven stress distribution), which causes a player to have different sensations when hitting the billiard ball to strike against the rail from various angles and with different strengths, thereby increasing the uncertainty when hitting the billiard ball and affecting the judgment on the billiard ball's trajectory. (3) The rebound kinetic energy loss rate and rebound accuracy are important indicators for evaluating the rail performance. Under the same working conditions, the smaller the rebound kinetic energy loss rate, the better the rail performance; and the higher the rebound accuracy, the better the rail performance. Through the comprehensive evaluation based on the above two indicators combined with the performance of the steel rail under different working conditions, the steel rail is considered to have a poor overall performance.

SUMMARY

In view of the above deficiencies in the prior art, the disclosure provides an integrated rail for a pool table, which not only has simple structure, shortened production cycle, easy assembly and less consumption of labor and material resources, but also has uniform stress distribution, low rebound kinetic energy loss rate and high rebound accuracy, which can improve the certainty of a movement trajectory of a billiard ball after hitting the rail.

In order to achieve the above object, the following technical solutions are adopted.

In a first aspect, this application provides an integrated rail for a pool table, comprising a block A, a block B and a block C;

wherein the block A, the block B and the block C are integrally formed; the integrated rail is arranged along an edge of a playing field of the pool table; the block B is arranged at an inner side of the block C; a bottom surface of the block B is higher than a bottom surface of the block C, such that the bottom surface of the block B is connected to the inner side of the block C to form a mounting surface for fitting the edge of the playing field; and a top surface of the block B and a top surface of the block C are both horizontal and at the same height; the block A is arranged on the top surface of the block B, and an outer end of the block A extends horizontally outward; and a handrail is provided on a top of the block C.

In some embodiments, the top of the block C is fixedly connected to the handrail.

In some embodiments, the outer end of the block A extends horizontally outward to the top of the C to integrally form the handrail.

In some embodiments, the integrated rail is made of a metal material.

In some embodiments, the metal material is an aluminum alloy.

In some embodiments, the integrated rail is made of a non-metallic material.

In some embodiments, the non-metallic material is carbon fiber or a fiber reinforced plastic.

In some embodiments, the bottom surface of the block B is provided with a bottom embedding groove along a length direction, and the bottom embedding groove is configured to crimp a table cloth of the playing field.

In some embodiments, the block A is provided with a top embedding groove along a length direction, and the top embedding groove is configured to crimp a top end of a table cloth of the playing field.

In some embodiments, the block C is configured to be divided by a vertical dividing plane I into a sub-block CI and a sub-block CII from the inside to the outside, wherein the sub-block CI is located at an inner side of the vertical dividing plane I, and the sub-block CII is located at an outer side of the vertical dividing plane I; a length direction of the integrated rail is defined as a Y-direction, a height direction of the integrated rail is defined as a Z-direction, and a width direction of the integrated rail is defined as an X-direction; and a minimum area $S_{min}$ of an XY cross-section of the sub-block CI satisfies the following formula:

$$S_{min} \geq \frac{F_{max}}{\sigma_s};$$

wherein $F_{max}$ is a maximum stress in the X-direction generated in the sub-block CI under an action of an external force; and $\sigma_s$ is a yield limit of a material of the integrated rail.

In some embodiments, the block C is configured to be divided by the vertical dividing plane I into the sub-block CI and the sub-block CII from the inside to the outside, wherein the sub-block CI is located at the inner side of the vertical dividing plane I, and the sub-block CII is located at the outer side of the vertical dividing plane I; a mass of a portion of the block A located at the inner side of the vertical dividing plane I is defined as $M_{A1}$, a mass of a portion of the block A located at the outer side of the vertical dividing plane I is defined as $M_{A2}$, a mass of the block B is defined as $M_B$, a mass of the sub-block CI is defined as $M_{CI}$, and a mass of the subblock CII is defined as $M_{CII}$; and $M_{A1}$, $M_{A2}$, $M_B$, $M_{CI}$ and $M_{CII}$ satisfy the following formula:

$$M_{A1} + M_B + M_{CI} \geq M_{A2} + M_{CII}.$$

In some embodiments, the block C is configured to be divided by the vertical dividing plane I into the sub-block CI and the sub-block CII from the inside to the outside, wherein the sub-block CI is located at the inner side of the vertical dividing plane I, and the sub-block CII is located at the outer side of the vertical dividing plane I; a mass of a portion of the block A located at the inner side of the vertical dividing plane I is defined as $M_{A1}$, a mass of a portion of the block A located at the outer side of the vertical dividing plane I is defined as $M_{A2}$, a mass of the block B is defined as $M_B$, a mass of the sub-block CI is defined as $M_{CI}$, and a mass of the sub-block CII is defined as $M_{CII}$; $M_{A1}$, $M_{A2}$, $M_B$, $M_{C1}$ and $M_{CII}$ satisfy the following formula:

$$M_{A1} + M_B + M_{CI} \geq M_{A2} + M_{CII};$$

and the block A extends horizontally outward to the vertical dividing plane I.

In some embodiments, a vertical dividing plane between the block B and the sub-block CI is defined as a vertical dividing plane II, and the outer end of the block A extends horizontally outward to the vertical dividing plane II.

In some embodiments, the block C is configured to be divided by the vertical dividing plane I into the sub-block CI and the sub-block CII from the inside to the outside, wherein the sub-block CI is located at the inner side of the vertical dividing plane I, and the sub-block CII is located at the outer side of the vertical dividing plane I; and the sub-block CII is a top support plate integrally formed on an upper end of an outer side surface of the sub-block CI; and the top support plate extends outward in a horizontal direction, and is configured to support the handrail provided thereon.

In some embodiments, the block C is configured to be divided by the vertical dividing plane I into the sub-block CI and the sub-block CII from the inside to the outside, wherein the sub-block CI is located at the inner side of the vertical dividing plane I, and the sub-block CII is located at the outer side of the vertical dividing plane I; the sub-block CII comprises a top support plate and a bottom support plate, and the top support plate and the bottom support plate are integrally formed with the sub-block CI; the top support plate extends outward in a horizontal direction, and is configured to support the handrail provided thereon; and the bottom support plate is arranged below the top support plate and parallel to the top support plate.

In some embodiments, a thickness of the top support plate is greater than that of the bottom support plate.

In some embodiments, the block C is configured to be divided by the vertical dividing plane I into the sub-block CI and the sub-block CII from the inside to the outside, wherein the sub-block CI is located at the inner side of the vertical dividing plane I, and the sub-block CII is located at the outer side of the vertical dividing plane I; and the block C consists of the sub-block CI.

In some embodiments, a top surface of the block A is provided with a top embedding groove.

In some embodiments, the block C is configured to be divided by a vertical dividing plane I into a sub-block CI and a sub-block CII from the inside to the outside, wherein the sub-block CI is located at an inner side of the vertical dividing plane I, and the sub-block CII is located at an outer side of the vertical dividing plane I; and the block C consists of the sub-block CI; and a width of the handrail is greater than that of the sub-block CI.

In some embodiments, the block C is configure to be divided by a vertical dividing plane I into a sub-block CI and a sub-block CII from the inside to the outside, wherein the sub-block CI is located at an inner side of the vertical dividing plane I, and the sub-block CII is located at an outer side of the vertical dividing plane I; and the block C comprises the sub-block CI and the sub-block CII; the sub-block CII is configured as a bottom support plate; an inner side of the bottom support plate is integrally formed with the sub-block CI; and the bottom support plate is spacedly arranged below the block A and parallel to the block A.

In some embodiments, a width of the block A is 12-16 cm.

In some embodiments, an inner side surface of the block B is integrally provided with a protruding structure, which is configured as a support structure for a rubber strip.

In some embodiments, the protruding structure is a support strip extending along a length direction of the integrated rail.

In some embodiments, a height H from a top surface of the support strip to the playing field is calculated by the following formula:

$$H = R\ (1 + \sin\theta)\ - Z1;$$

wherein a striking point of a billiard ball on a rubber strip II is defined as J, and the striking point is located higher than a center point O of the billiard ball in a vertical direction; R is a radius of the billiard ball; θ is an angle between a line OJ connecting the center point O and the striking point J and the playing field; and Z1 is a vertical distance between the striking point J and the top surface of the support strip.

In some embodiments, a value range of θ is $2° \leq \theta \leq 8°$.

In some embodiments, the block C is configured to be divided by a vertical dividing plane I into a sub-block CI and a sub-block CII from the inside to the outside, wherein the sub-block CI is located at an inner side of the vertical dividing plane I, and the sub-block CII is located at an outer side of the vertical dividing plane I; the sub-block CI is integrally formed with the block A and the block B to form a main body of the integrated rail; the sub-block CII comprises a top support plate and a bottom support plate; and the bottom surface of the block B is connected to an inner side of the block C to form a right-angled open groove; the top support plate and the bottom support plate are arranged on an outer side of the main body of the integrated rail, and both extend horizontally outward; a support strip is provided on an inner side of the main body of the integrated rail for supporting a rubber strip; and the support strip is integrally formed with the main body of the integrated rail, and extends along a length direction of the main body; the right-angled open groove is arranged at an inner bottom of the main body of the integrated rail, and is formed by perpendicular connection of a horizontal bottom surface of the block B and a vertical surface at an inner side of the sub-block CI; and the horizontal bottom surface of the block B is configured to abut against a top surface of the playing field, and the vertical surface at the inner side of the sub-block CI is configured to abut against an outer side surface of the playing field; the top support plate and the bottom support plate are arranged in parallel, and the bottom support plate is spacedly arranged below the top support plate; the top support plate and the bottom support plate are both arranged perpendicularly to the main body of the integrated rail; and a decorative plate is provided between the top support plate and the bottom support plate; and a top surface of the main body of the integrated rail is higher than a top surface of the top support plate; and a top of the outer side of the main body of the integrated rail is provided with a step surface A, and is configured to mount the handrail.

In some embodiments, a vertical portion of the step surface A is provided with a top embedding groove along a length direction.

In some embodiments, a plurality of through holes are provided on the sub-block CI along a length direction, and are configured to mount the integrated rail to the playing field.

In some embodiments, the integrated rail has a total width of 12-16 cm and a total height of 9-13 cm.

Compared with the prior art, this disclosure has the following advantages.

(1) This application includes the block A, the block B and the block C integrally formed. First of all, the integrated rail has an integrated structure, of which individual portions are made of the same material. The stress generated by striking of a billiard ball can be spread through the entire rail, such that the stress can be evenly distributed, thereby allowing a player to have the same hitting sensation when hitting the billiard ball against the rail with various strengths at various angles, which can reduce the uncertainty when hitting the billiard ball and enhance the game experience. Secondly, compared with the traditional steel rails, it is not required to separately produce the steel plate and the back-lining wooden strip, and the separate processing, positioning and assembly procedures of the steel plate and the back-lining wooden strip are also eliminated, simplifying the manufacturing process and improving the assembly efficiency.

(2) In this application, the outer end of the block A can extend horizontally outward to the top of the block C to serve as the handrail, that is, the handrail is also integrally formed, and the separate processing and positioning assembly procedures of the handrail are eliminated, thereby simplifying the manufacturing process and improving the assembly efficiency.

In addition, compared with the arrangement of the sub-block CI only, the presence of the integrated handrail can allow the stress generated by hitting the billiard ball to spread in a wider range and result in a more uniform stress distribution, thereby allowing the player to have the same hitting sensation when hitting the billiard ball against the rail with various strengths at various angles, which can reduce the uncertainty when hitting the billiard ball and enhance the game experience.

(3) The integrated rail in this application can be made of aluminum alloy. The stress distribution of the integrated rail is more uniform than that of the steel rail when stricken by the billiard ball, such that under the same working conditions, a maximum stress in the integrated rail is less than a maximum stress in the steel rail. Therefore, the aluminum alloy with a relatively small elastic modulus can be selected to ensure that the strain of the integrated rail can meet requirements under different working conditions. Moreover, the aluminum alloy has low density, light weight, easy processing, high strength, high toughness and excellent corrosion resistance, which can reduce a weight of the rail and extend a service life of the rail.

In addition, according to simulation analysis results, under the same collision speed and incident angle, an integrated aluminum alloy rail is generally better than the steel rail in terms of rebound kinetic energy loss rate and rebound accuracy. When comprehensively evaluating all collision conditions, the integrated aluminum alloy rail has a higher score than the steel rail. Therefore, the integrated rail has better rebound performance, and less uncertainty of a motion trajectory of the billiard ball after striking against the rail, thereby offering better game experience.

(4) In the present disclosure, the bottom surface of the block B is provided with the bottom embedding groove along the length direction, which can cooperate with a pressing block to hide a bottom of the table cloth, so as to make the table cloth flat and keep the pool table in an elegant appearance.

(5) The block A in the present disclosure is provided with the top embedding groove along the length direction, which can cooperate with a pressing strip to hide a top of the table cloth, so as to make the table cloth flat and keep the pool table in an elegant appearance.

(6) In the present disclosure, the minimum area of the XY cross-section of the sub-block CI is limited to satisfy $$S_{min} \geq \frac{F_{max}}{\sigma_s}.$$

According to this formula, the minimum area of the XY cross-section can be obtained based on an X-direction stress generated in the sub-block CI after the external force is applied to the sub-block CI. When a Y-direction length of the sub-block CI is determined, a minimum thickness of the sub-block CI in the X-direction can be calculated, so as to reduce the consumption of materials to the maximum extent while meeting the strength requirements.

(7) In the present disclosure, the mass $M_{A1}$ of the portion of the block A located at the inner side of the vertical dividing plane I, the mass $M_{A2}$ of the portion of the block A located at the outer side of the vertical dividing plane I, the mass $M_B$ of the block B, the mass $M_{CI}$ of the sub-block CI and the mass $M_{CII}$ of the sub-block CII are limited to satisfy the following formula: $M_{A1}+M_B+M_{CI} \geq M_{A2}+M_{CII}$. A gravity center of the integrated rail is located on the sub-block CI or at the inner side of the sub-block CI, which can reduce the influence of a moment generated by the weight of the sub-block CII on the stability of the rail, thereby ensuring the stability and durability of the rail and achieving the labor-saving assembly.

(8) The block A in the present disclosure extends horizontally outward along the top surface of the block B furthest to the vertical dividing plane I, which is necessary for maximizing the strength of the sub-block CII.

(9) In the present disclosure, the vertical dividing plane between the block B and the sub-block CI is the vertical dividing plane II, and the block A extends horizontally outward along the top surface of the block B to the vertical dividing plane II, such that an outer end surface of the block A can be vertically flush with the outer side of the playing field, allowing for an elegant appearance.

(10) The sub-block CII in the present disclosure can be a top support plate. The inner side of the top support plate is integrally formed with the sub-block CI, and the top support plate extends in the horizontal direction to support the handrail provided thereon, which can facilitate the mounting of the handrail.

In addition, the top support plate is integrally formed on the outer side of the sub-block CI. Compared with the arrangement of the sub-block CI only, the stress generated by striking of the billiard ball can be spread in a wider range, thereby resulting in a more uniform stress distribution, and further allowing the player to have the same hitting sensation when the billiard ball strikes against the rail with various strengths at various angles, which can reduce the uncertainty when hitting the billiard ball to strike the rail and enhance the game experience.

(11) The sub-block CII in the present disclosure can include the top support plate and the bottom support plate. The top support plate can support the handrail thereon while improving the rebound performance of the pool table. The decorative plate can be provided between the top support plate and the bottom support plate, thereby making a peripherical structure of the pool table simple and improving the overall appearance of the pool table.

In addition, the top support plate and the bottom support plate are integrally formed on the outer side of the sub-block CI. Compared with the arrangement of the sub-block CI only, the stress generated by striking of the billiard ball can be spread in a wider range, thereby resulting in a more uniform stress distribution, further allowing the player to have the same hitting sensation when hitting the billiard ball against the rail with various strengths at various angles, which can reduce the uncertainty when hitting the billiard ball and enhance the game experience.

(12) In the present disclosure, the outer end of the block A can extend horizontally outward along the top surface of the block B to the top of the block C as an integrated handrail, and the block C only includes the sub-block CI. The width of the handrail is greater than that of the sub-block CI. According to the following formula: $M_{A1}+M_B+M_{CI} \geq M_{A2}+M_{CII}$, when the mass $M_{CII}$ of the sub-block CII is zero, it can ensure that the mass $M_{A2}$ of the block A located at the outer side of the vertical dividing plane I is maximum. Therefore, when the width of the block A in the X-direction and the length of the block A in the Y-direction are determined, the block A has t maximum thickness in the Z-direction and a maximum strength.

(13) In the present disclosure, the outer end of the block A can extend horizontally outward along the top surface of the block B as the integrally formed handrail. The block C includes the sub-block CI and the sub-block CII. The sub-block CII is the bottom support plate. The inner side of the bottom support plate is integrated with the sub-block CI. The bottom support plate is spacedly arranged below the block A and parallel to the block A. The decorative plate can be provided between the block A and the bottom support plate, thereby making the peripherical structure of the pool table simple and improving the overall appearance of the pool table.

In addition, compared with the arrangement of the sub-block CI only, the integrated handrail and the sub-block CII can allow the stress generated by striking of the billiard ball to be spread in a wider range and result in a more uniform stress distribution, further allowing the player to have the same hitting sensation when hitting the billiard ball against the rail with various strengths at various angles, which can reduce the uncertainty when hitting the billiard ball and enhance the game experience.

(14) In the present disclosure, the inner surface of the block B is integrally provided with the protruding structure for supporting the rubber strip. In this application, the protruding structure is also processed in an integrated manner, thereby further simplifying the manufacturing process and improving assembly efficiency.

(15) The protruding structure in the present disclosure is a support strip extending along the length direction of the rail. The height H from the top surface of the support strip to the playing field is $(R(1+\sin\theta)-Z1)$, where $\theta$ is the angle between the line OJ connecting the center O and the striking point J and the playing field, and the striking point J is located higher than the center O of the billiard ball in the vertical direction. The height H from the top surface of the support strip to the playing field is related to the angle $\theta$, such that the striking force generated when the billiard ball strikes against the rubber strip can form an oblique downward component to prevent the billiard ball from jumping upward, thus preventing the billiard ball from jumping when hitting the rubber strip and improving the hitting experience.

In the prior art: 1—table cloth; 2—rubber strip I; 3—pressing strip; 4—steel plate; 5—wooden handrail; 6—handrail screw; 7—slate; 8—nut; 9—bolt; 10—lower-lining wooden strip; 11—back-lining wooden strip; and 12—screw.

In the present disclosure: 101—bottom embedding groove; 102—top embedding groove; 103—top support plate; 104—bottom support plate; 105—table cloth; 106—support strip; 107—mounting through hole; 108—playing field; 109—pressing block; 111—rubber strip II; 112—pressing strip; 113—handrail; 14—decorative plate; 115—bolt; 116—nut; 117—right-angled open groove; 1171—horizontal surface; 1172—vertical surface; 118—main body; 1181—top surface of the main body; 1182—vertical portion of step surface; and 1031—top surface of the top support plate.

DETAILED DESCRIPTION OF EMBODIMENTS

The present disclosure will be described in detail below with reference to the accompanying drawings and embodiments.

Embodiment 1

Figure 1:
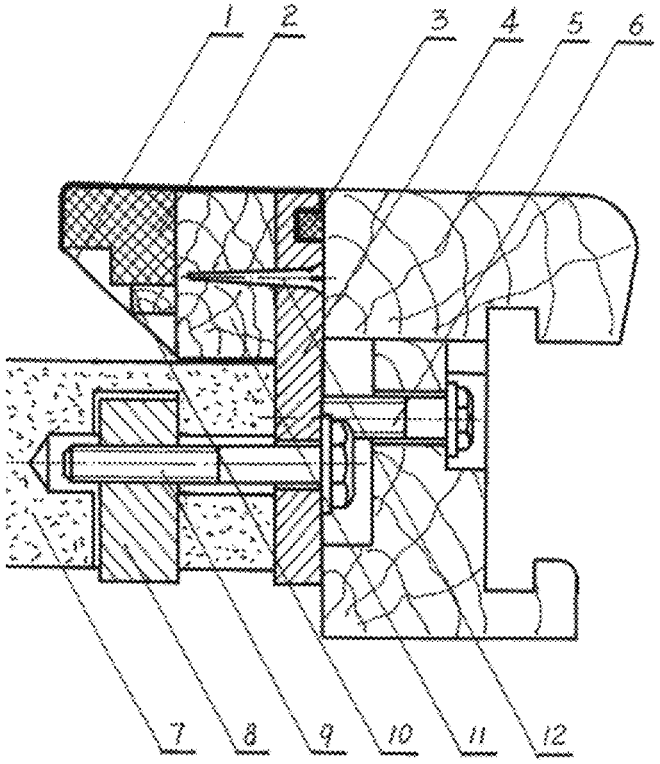
FIG. 1 is a sectional view of a rail of a pool table in the prior art.
Figure 2:
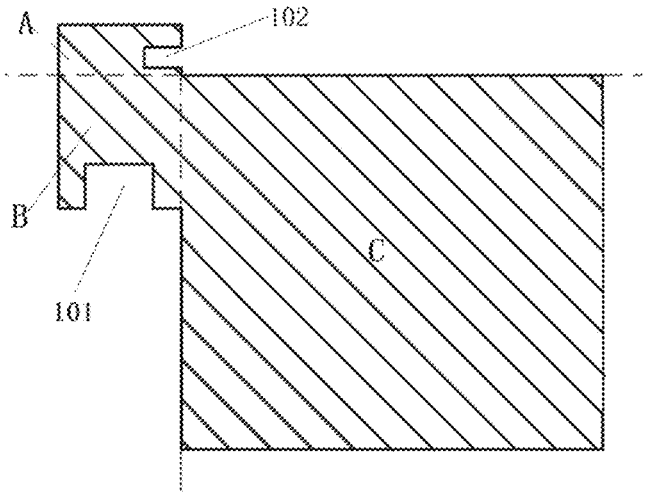
FIG. 2 is a sectional view of blocks of an integrated rail in accordance with an embodiment of the present disclosure.

Referring to an embodiment in FIG. 2, an integrated rail for a pool table is provided, which includes a block A, a block B and a block C. The block A, the block B and the block C are integrally formed.

For the convenience of description, a length direction of the integrated rail is defined as a Y-direction, a height direction of the integrated rail is defined as a Z-direction, and a width direction of the integrated rail is defined as an X-direction.

The integrated rail is arranged along an edge of a playing field of the pool table. The block B is arranged at an inner side of the block C. A bottom surface of the block B is higher than a bottom surface of the block C, such that the bottom surface of the block B can be connected to the inner side of the block C to form a mounting surface for fitting the edge of the playing field. A top surface of the block C and a top surface of the block B are both horizontal and at the same height (i.e., the block C and the block B are in the same horizontal plane).

The bottom surface of the block B is provided with a bottom embedding groove 101 along a length direction, and the bottom embedding groove 101 is configured to crimp a bottom of a table cloth of the playing field.

The block A is arranged on the top surface of the block B, and an outer end of the block A extends horizontally outward. The block A is provided with a top embedding groove 102 along a length direction, and the top embedding groove 102 is configured to crimp a top end of the table cloth.

A handrail is provided on a top of the block C. The handrail can be a fixedly connected handrail or an integrated handrail.

The above integrated rail adopts an integrally-formed overall structure. First of all, the integrated rail has an integrated structure, of which individual portions are made of the same material. The stress generated by striking of a billiard ball can be spread through the entire rail, such that the stress can be evenly distributed, thereby allowing a player to have the same hitting sensation when hitting the billiard ball against the rail with various strengths at various angles, which can reduce the uncertainty when hitting the billiard ball and enhance the game experience. Secondly, compared with the traditional steel rails, it is not required to separately produce the steel plate and the back-lining wooden strip, and the separate processing, positioning and assembly procedures of the steel plate and the back-lining wooden strip are also eliminated, simplifying the manufacturing process and improving the assembly efficiency.

The integrated rail can be integrally made of a metal material or a non-metal material. The metal material can be an aluminum alloy, and the non-metal material can be a carbon fiber or a fiber reinforced plastic.

In some embodiments, the integrated rail can be made of the aluminum alloy. The stress distribution of the integrated rail is more uniform than that of the steel rail when stricken by the billiard ball, such that under the same working conditions, a maximum stress in the integrated rail is less than a maximum stress in the steel rail. Therefore, the aluminum alloy with a relatively small elastic modulus can be selected to ensure that the strain of the integrated rail can meet requirements under different working conditions. Moreover, the aluminum alloy has low density, light weight, easy processing, high strength, high toughness and excellent corrosion resistance, which can reduce a weight of the rail and extend a service life of the rail.

In addition, simulation analysis was conducted on the integrated rail made of aluminum alloy and the steel rail. The results showed that under the same collision speed and incident angle, the integrated rail is generally better than the steel rail in terms of rebound kinetic energy loss rate and rebound accuracy. When weights of the rebound kinetic energy loss rate and the rebound accuracy are both 0.5, a comprehensive evaluation of all collision conditions is conducted. It can be obtained that the integrated rail has a higher score than the steel rail, i.e., the integrated rail made of the aluminum alloy has better resilience.

Embodiment 2

Figure 4:
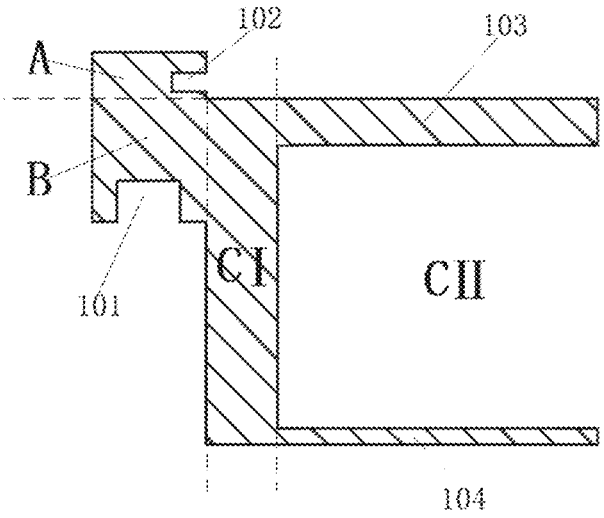
FIG. 4 is a sectional view of the integrated rail in accordance with an embodiment of the present disclosure (the sub-block CII includes a top support plate and a bottom support plate)
Figure 5:
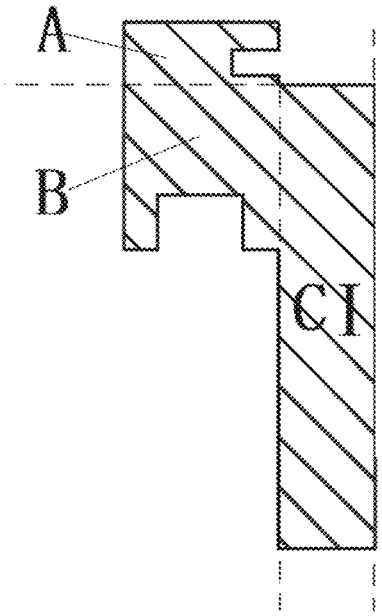
FIG. 5 is a sectional view of the integrated rail in accordance with an embodiment of the present disclosure (a block C only includes a sub-block CI)

Referring to an embodiment in FIGS. 4-5, an integrated rail for a pool table is provided based on Embodiment 1. A block C is configured to be divided by a vertical dividing plane I into a sub-block CI and a sub-block CII from the inside to the outside. The sub-block CI is located at an inner side of the vertical dividing plane I, and the sub-block CII is located at an outer side of the vertical dividing plane I. An inner side of the sub-block CI is integrally formed with the block B. The sub-block CII is integrally formed on an outer side of the sub-block CI.

Compared with the arrangement of the sub-block CI only, the presence of the integrated handrail can allow the stress generated by hitting the billiard ball to spread in a wider range and result in a more uniform stress distribution, thereby allowing the player to have the same hitting sensation when hitting the billiard ball against the rail with various strengths at various angles, which can reduce the uncertainty when hitting the billiard ball and enhance the game experience.

A minimum area $S_{min}$ of an XY cross-section of the sub-block CI needs to satisfy Formula (1):

$$S_{min} \geq \frac{F_{max}}{\sigma_s}. \tag{1}$$

After an external force is applied to the sub-block CI, an X-direction stress F is generated in the sub-block CI. Influencing factors of F include various horizontal forces exerted on the sub-block CI, such as a ball speed when the billiard ball strikes against the rail, a weight of the sub-block CII and a vertical force exerted by the player on the handrail. $\sigma_s$ is a yield limit of a material of the integrated rail.

Based on a horizontal force exerted on the sub-block CI, such as a maximum ball speed when hitting the billiard ball to strike against the rail (the maximum ball speed when the billiard ball hits the rail is an empirical value, and 30 m/s is used in an actual simulation calculation), an actual weight of the sub-block CII and a maximum vertical force exerted by the player on a CII area (a maximum vertical force exerted by the player on the handrail is a preset value, which can be set according to actual needs) and other external forces, a maximum stress $F_{max}$ in the X-direction, which is generated in the sub-block CI, can be calculated comprehensively. According to Formula (1), when a length of the sub-block CI in the Y-direction is determined, a minimum thickness of the sub-block CI in the X-direction can be calculated, so as to reduce the consumption of materials to the maximum extent while meeting the strength requirements. In some embodiments, the length of the sub-block CI in the Y-direction is 1260 mm, and a yield limit of the aluminum alloy is 265 MPa.

Embodiment 3

Based on Embodiment 2, an integrated rail for a pool table is provided, where a mass of a portion of a block A located at an inner side of a vertical dividing plane I is $M_{A1}$, a mass of a portion of the block A located at an outer side of the vertical dividing plane I is $M_{A2}$, a mass of a block B is $M_B$, a mass of a sub-block CI is $M_{CI}$, and a mass of a sub-block CII is $M_{CII}$. $M_{A1}$, $M_{A2}$, $M_B$, $M_{CI}$ and $M_{CII}$ satisfy Formula (2):

$$M_{A1} + M_B + M_{CI} \geq M_{A2} + M_{CII}. \tag{2}$$

According to Formula (2), a gravity center of the integrated rail is located on the sub-block CI or at an inner side of the sub-block CI, which can reduce the influence of a moment generated by a weight of the sub-block CII on the stability of the rail, thereby ensuring the stability and durability of the rail and achieving the labor-saving assembly.

An outer end of the block A extends horizontally outward along a top surface of the block B to the vertical dividing plane I, which can provide necessary conditions for maximizing the strength of the sub-block CII. The reason is that according to Formula (1), when a value of $(M_{A1}+M_B+M_{CI})$ is determined, in order to ensure that $M_{CII}$ reaches the maximum, i.e., to ensure that the sub-block CII has a maximum thickness in a height direction, so as to provide a maximum support strength for the handrail, $M_{A2}=0$, i.e., the outer end of the block A extends horizontally outward along the top surface of the block B to the vertical dividing plane I.

In some embodiments, a dividing plane between the block B and the sub-block CI is a vertical dividing plane II, and the outer end of the block A extends horizontally outward along the top surface of the block B to the vertical dividing plane II, i.e., an outer end surface of the block A is vertically flush with an outer surface of a playing field, allowing for an elegant appearance.

Embodiment 4

Figure 3:
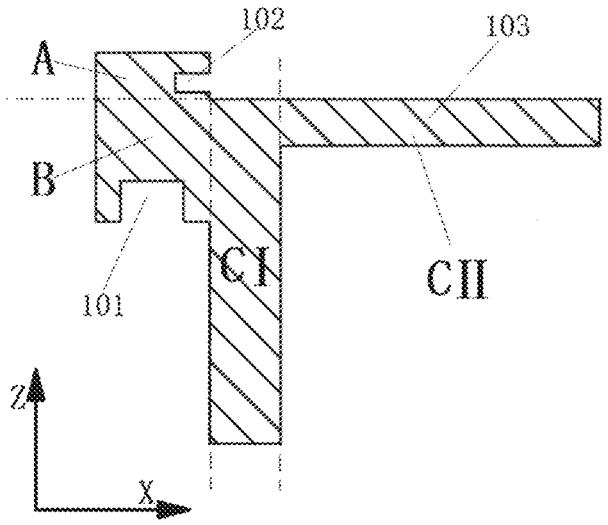
FIG. 3 is a sectional view of the integrated rail in accordance with an embodiment of the present disclosure (a sub-block CII only includes a top support plate)

Referring to an embodiment in FIG. 3, an integrated rail for a pool table is provided based on Embodiment 2 or 3. A sub-block CII is a top support plate 103 integrally formed on an outer surface of a sub-block CI. An inner surface of the top support plate 103 is integrated with the sub-block CI, and extends outward in a horizontal direction, which can be configured to support the handrail provided thereon, such that the handrail can be arranged above the top support plate 103 to facilitate the mounting of the handrail.

Embodiment 5

Referring to an embodiment in FIG. 4, an integrated rail for a pool table is provided based on Embodiment 2 or 3. A sub-block CII includes a top support plate 103 and a bottom support plate 104, which are integrally formed with a sub-block CI. A bottom support plate 104 is arranged below the top support plate 103 and parallel to the top support plate 103. A thickness of the top support plate 103 is greater than that of the bottom support plate 104 (a dimension in a height direction of the support plate is defined as the thickness, i.e., a Z-direction as shown in FIG. 4). A vertical decorative plate is provided between the top support plate 103 and the bottom support plate 104, thereby making a peripherical structure of the pool table simple and improving the overall appearance of the pool table. The top support plate 103 is mainly configured to bear load, such that the thickness of the top support plate 103 is greater than that of the bottom support plate 104 to ensure the strength of the top support plate 103.

Embodiment 6

Referring to an embodiment in FIG. 5, an integrated rail for a pool table is provided based on Embodiment 2 or 3. In an embodiment, a block C only includes a sub-block CI, excluding a sub-block CII. A top of the block C is fixedly connected with a handrail (such as a wooden handrail or other handrail, which is not shown in FIG. 5).

The above vertical dividing plane I and vertical dividing plane II are dividing planes for dividing blocks for convenience of description, and each block is actually integrally formed.

Embodiment 7

Figure 6:
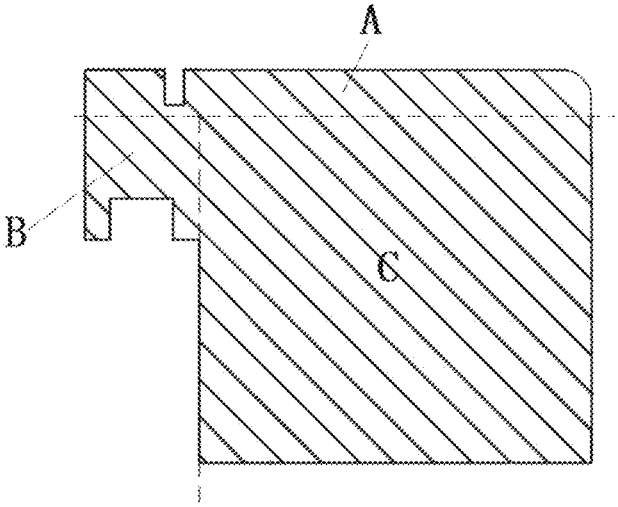
FIG. 6 is a sectional view of the integrated rail in accordance with an embodiment of the present disclosure (a handrail is integrally formed)

Referring to an embodiment in FIG. 6, an integrated rail for a pool table is provided based on Embodiment 1 or 2. In this embodiment, an outer end of a block A directly extends horizontally outward along a top surface of a block B to a top of a block C as an integrated handrail. A top embedding groove 102 is provided on a top surface of the block A, which can facilitate the crimping of a table cloth.

In this embodiment, the handrail is integrally formed, and separate processing and positioning assembly procedures of the handrail are eliminated, thereby simplifying the manufacturing process and improving the assembly efficiency.

Figure 7:
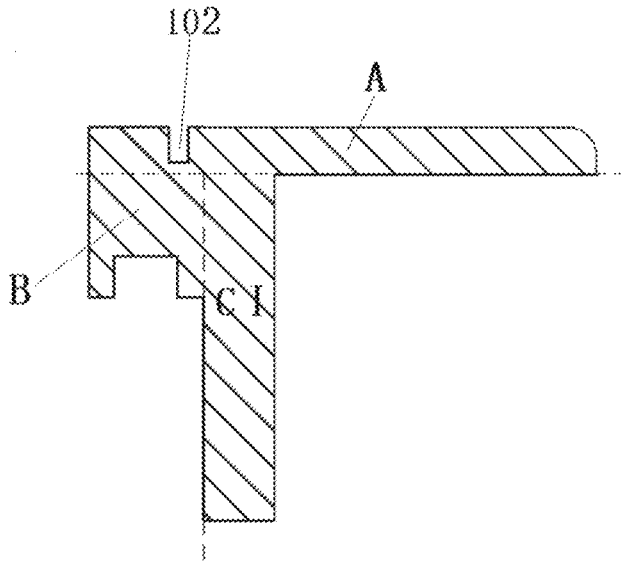
FIG. 7 is a sectional view of the integrated rail in accordance with an embodiment of the present disclosure (the handrail is integrally formed, and the sub-block CII is absent)

In an embodiment, as shown in FIG. 7, the block C only includes a sub-block CI. A width of the handrail is greater than that of the sub-block CI (i.e., a size of the handrail in an X-direction). According to Formula (1) in Embodiment 3, when a mass $M_{CII}$ of a sub-block CII is zero, it can be ensured that a mass $M_{A2}$ of a portion of the block A located at an outer side of a vertical dividing plane I is the largest, such that when a width of the block A in the X-direction and a length of the block A in a Y-direction are determined, the block A has a largest thickness and a greatest strength in a Z-direction.

Figure 8:
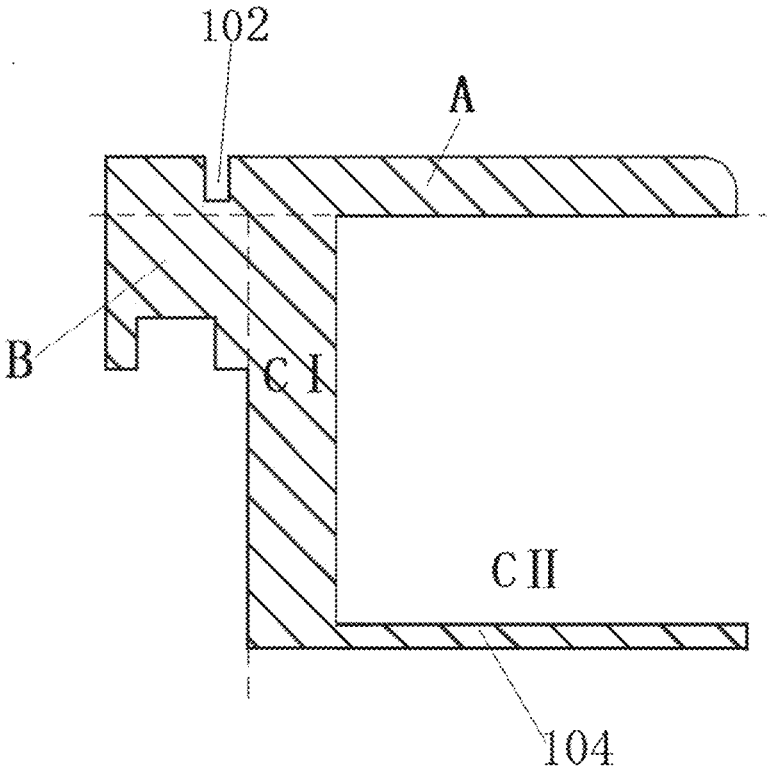
FIG. 8 is a sectional view of the integrated rail in accordance with an embodiment of the present disclosure (the handrail is integrally formed, and the sub-block CII includes a bottom support plate)

Referring to an embodiment in FIG. 8, the block C includes the sub-block CI and the sub-block CII. The sub-block CII is a bottom support plate 104. An inner side of the bottom support plate 104 is integrated with the sub-block CI. The bottom support plate 104 is spacedly arranged below the block A and parallel to the block A. A vertical decorative plate can be provided between a bottom surface of the block A and the bottom support plate 104, thereby making a peripherical structure of the pool table simple.

In some embodiments, the width of the block A (i.e., a size along the X-direction) is 12-16 cm, such as 12 cm, 12.5 cm, 13 cm, 13.5 cm, 14 cm, 14.5 cm, 15 cm, 15.5 cm and 16 cm.

Embodiment 8

Figure 9:
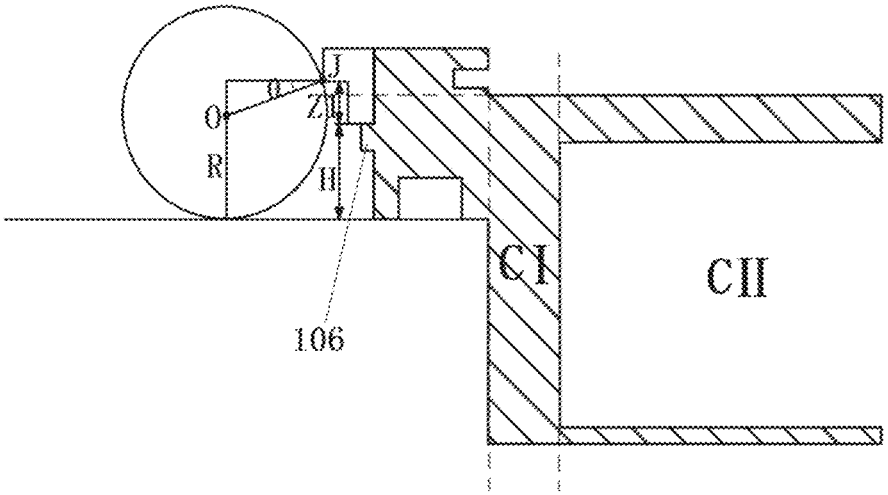
FIG. 9 is a sectional view of the integrated rail with a support strip for a rubber strip in accordance with an embodiment of the present disclosure.

Referring to an embodiment in FIG. 9, an integrated rail for a pool table is provided based on Embodiments 1-7. A protruding structure is integrally formed on an inner surface of a block B as a support structure for a rubber strip. The protruding structure can be a support strip 106 extending along a length direction of the rail. A rubber strip II 111 is arranged on the support strip 106. The support strip 106 is integrally formed, and separate processing and positioning assembly procedures of lower-lining wooden strips are eliminated, thereby further simplifying the manufacturing process and improving the assembly efficiency. A cross section of the support strip 106 can be rectangular, L-shaped, etc.

A height H from a top surface of the support strip 106 to a playing field can be calculated through Formula (3):

$$H = R(1 + \sin\theta) - Z1. \quad (3)$$

As shown in FIG. 9, a striking point of a billiard ball on the rubber strip II 111 is defined as J, and the striking point is higher than a center of the billiard ball in a vertical direction. R is a radius of the billiard ball. θ is an angle between a line OJ connecting the center O of the billiard ball and the striking point J and the playing field, which satisfies $2° \leq \theta \leq 8°$. Z1 is a vertical distance between the striking point J on the rubber strip and the top surface of the support strip 106. When a cross section of the rubber strip II 111 is rectangular, Z1=0.

The height H from the top surface of the support strip 106 to the playing field is greater than the radius of the billiard ball, such that the striking force generated by when the billiard ball strikes against the rubber strip can form an oblique downward component to prevent the billiard ball from jumping upward, thus preventing the billiard ball from jumping when the billiard ball strikes against the rubber strip.

Embodiment 9

Figure 10:
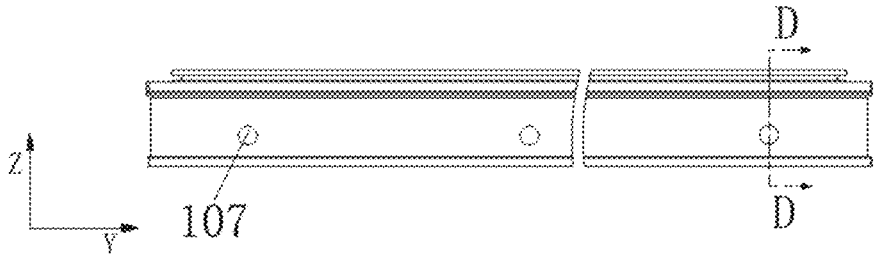
FIG. 10 is a front view of the integrated rail in accordance with an embodiment of the present disclosure.
Figure 11:
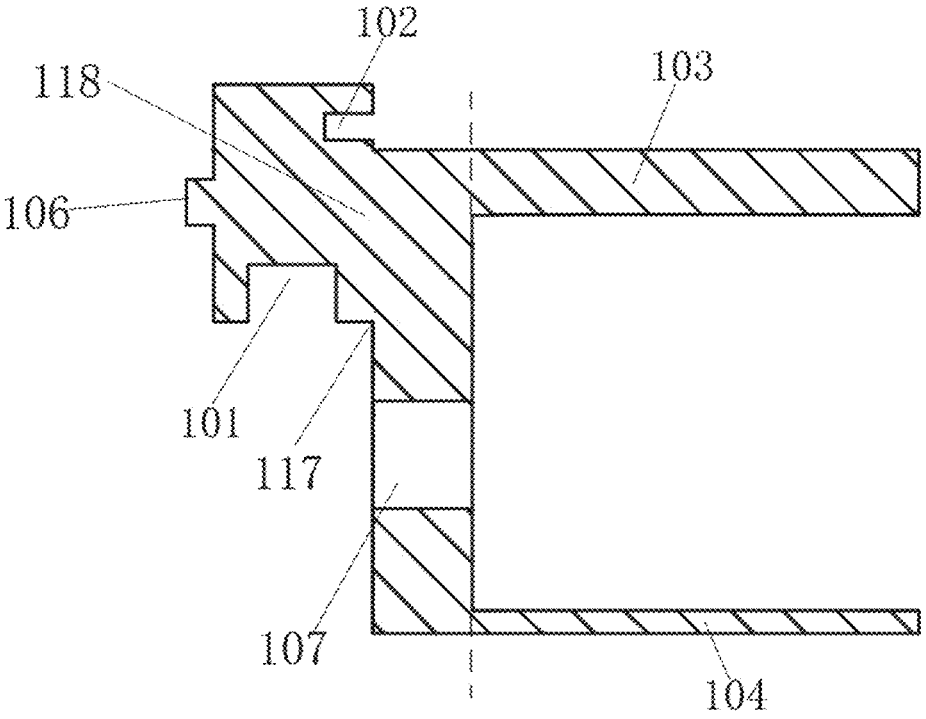
FIG. 11 is a sectional view I of the integrated rail along D-D in FIG. 10.
Figure 12:
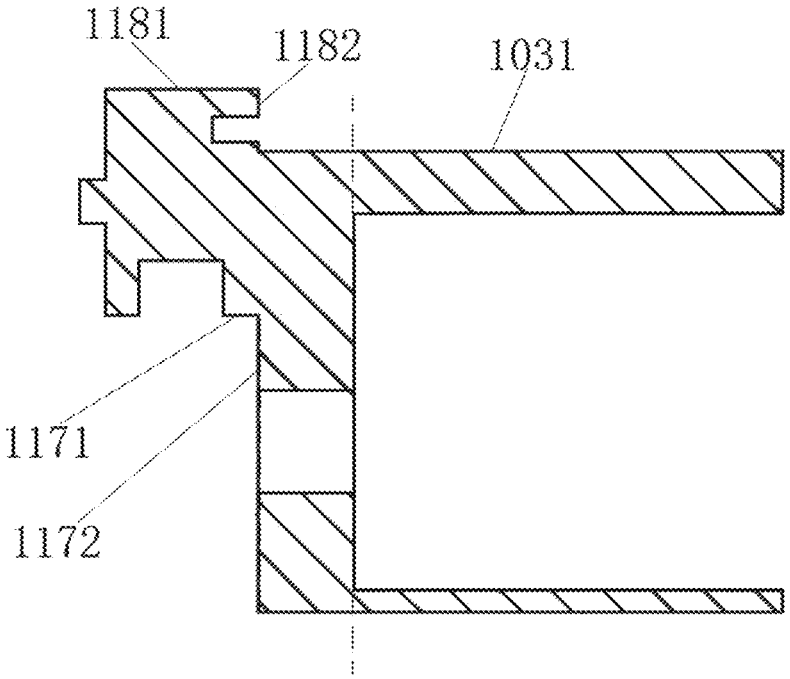
FIG. 12 is a sectional view II of the integrated rail along D-D in FIG. 10.

Referring to a specific embodiment in FIGS. 10-12, an integrated rail for a pool table is provided. In this embodiment, a sub-block CI is integrated with a block A and a block B to form a main body 118. A block CII includes a top support plate 103 and a bottom support plate 104. A bottom surface of the block B is connected to an inner surface of the block C to form a right-angled open groove 117.

Materials of the main body 118, the top support plate 103 and the bottom support plate 104 are all aluminum alloy.

A support strip 106 and the right-angled open groove 117 are arranged at an inner side of the main body 118. The top support plate 103 and the bottom support plate 104 are arranged at an outer side of the main body 118, which both extend outward along an X-direction.

The support strip 106 is integrally formed with the main body 118, and extends along a length direction (i.e., a Y-direction) of the main body 118.

The right-angled open groove 117 is arranged at an inner bottom of the main body 118, and is formed by perpendicular connection of a horizontal bottom surface of the block B and a vertical surface at an inner side of the sub-block CI. The horizontal surface 1171 is vertically connected to the vertical surface 1172. The horizontal surface 1171 is configured to abut with a top surface of a playing field, and the vertical surface 1172 is configured to abut against an outer side surface of the playing field.

The top support plate 103 and the bottom support plate 104 are arranged in parallel, and the bottom support plate 104 is spacedly arranged below the top support plate 103. The top support plate 103 and the bottom support plate 104 are both arranged perpendicularly to with the main body 118. A decorative plate 114 is provided between the top support plate 103 and the bottom support plate 104.

A top surface of the main body 1181 is higher than a top surface of the top support plate 1031. A top of the outer side of the main body of the integrated rail is provided with a step surface A, and is configured to mount the handrail.

A bottom embedding groove 101 is provided on the horizontal surface 1171. A top embedding groove 102 is provided on a vertical portion 1182 of the step surface A.

The sub-block CI is provided with a plurality of mounting through holes 107 along a length direction of the block CI, which are configured to mount the rail to the playing field.

A total width of the integrated rail can be 12-16 cm, such as 12 cm, 12.5 cm, 13 cm, 13.5 cm, 14 cm, 14.5 cm, 15 cm, 15.5 cm and 16 cm. A total height of the integrated rail can be 9-13 cm, such as 9 cm, 9.5 cm, 10 cm, 10.5 cm, 11 cm, 11.5 cm, 12 cm, 12.5 cm and 13 cm.

Assembly Principle

Figure 13:
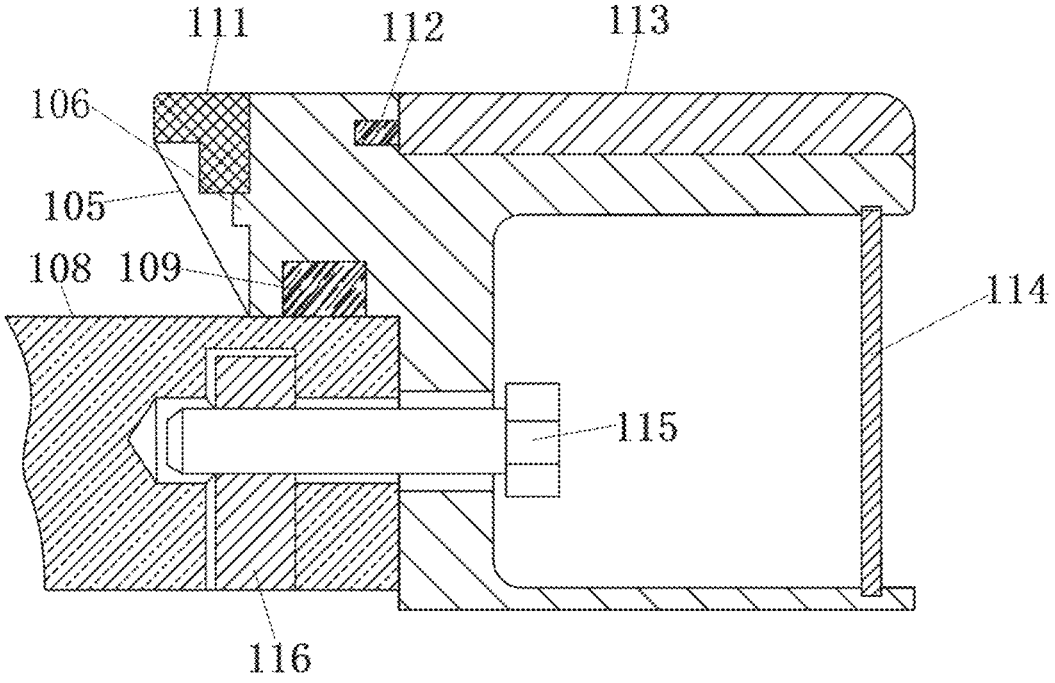
FIG. 13 illustrates an assembly of the integrated rail in accordance with an embodiment of the present disclosure with external components.

As shown in FIG. 13, peripheral components include the playing field 108, a pressing block 109, the table cloth 105, the rubber strip II 111, a pressing strip 112, the handrail 113 and the decorative plate 114.

The right-angled open groove 117 is matched with the edge of the playing field 108. A plurality of bolts 115 threadedly pass through the plurality of mounting through holes 107 on the main body 118 and the playing field 108, and are tightened by a plurality of nuts 116, respectively, such that the integrated rail is assembled to the playing field 108.

The rubber strip II 111 is provided inside the block B, and is arranged on a top of the support strip 106. A first end of the table cloth 105 is crimped in the top embedding groove 102 through the pressing strip 112. A second end of the table cloth 105 is wrapped around the top surface of the block A and the rubber strip II 111, and is crimped in the bottom embedding groove 101, thereby achieving the fixation of the table cloth 105 and the hiding of ends of the table cloth 105. The handrail 113 is fixedly provided on the top surface of the top support plate 103. A top surface of the handrail 113 is at the same height as the top surface of the main body 1181. The decorative plate 114 is vertically arranged between the top support plate 103 and the bottom support plate 104.

In summary, the embodiments described above are merely illustrative of the present application, and are not intended to limit the scope of the present application. Various modifications, replacements and improvements made by those of ordinary skill in the art without departing from the spirit of this application shall fall within the scope of the disclosure defined by the appended claims.

The invention claimed is:

1. An integrated rail for a pool table, comprising:

a block A;

a block B; and a block C;

wherein the block A, the block B and the block C are integrally formed; the integrated rail is arranged along an edge of a playing field of the pool table; the block B is arranged at an inner side of the block C; a bottom surface of the block B is higher than a bottom surface of the block C, such that the bottom surface of the block B is connected to the inner side of the block C to form a mounting surface for fitting the edge of the playing field; and a top surface of the block B and a top surface of the block C are both horizontal and at the same height;

the block A is arranged on the top surface of the block B, and an outer end of the block A extends horizontally outward; and a handrail is provided on a top of the block C.

2. The integrated rail of claim 1, characterized in that the top of the block C is fixedly connected to the handrail.

3. The integrated rail of claim 1, characterized in that the outer end of the block A extends horizontally outward to the top of the C to integrally form the handrail.

4. The integrated rail of claim 1, characterized in that the integrated rail is made of a metal material.

5. The integrated rail of claim 4, characterized in that the metal material is an aluminum alloy.

6. The integrated rail of claim 1, characterized in that the integrated rail is made of a non-metallic material.

7. The integrated rail of claim 6, characterized in that the non-metallic material is a carbon fiber or a fiber reinforced plastic.

8. The integrated rail of claim 1, characterized in that the bottom surface of the block B is provided with a bottom embedding groove along a length direction, and the bottom embedding groove is configured to crimp a table cloth of the playing field.

9. The integrated rail of claim 1, characterized in that the block A is provided with a top embedding groove along a length direction, and the top embedding groove is configured to crimp a top end of a table cloth of the playing field.

10. The integrated rail of claim 1, characterized in that the block C is configured to be divided by a vertical dividing plane I into a sub-block CI and a sub-block CII from the inside to the outside, wherein the sub-block CI is located at an inner side of the vertical dividing plane I, and the sub-block CII is located at an outer side of the vertical dividing plane I;

a length direction of the integrated rail is defined as a Y-direction, a height direction of the integrated rail is defined as a Z-direction, and a width direction of the integrated rail is defined as an X-direction; and a minimum area $S_{min}$ of an XY cross-section of the sub-block CI satisfies the following formula:

$$S_{min} \geq \frac{F_{max}}{\sigma_s};$$

wherein $F_{max}$ is a maximum stress in the X-direction generated in the sub-block CI under an action of an external force; and $\sigma_s$ is a yield limit of a material of the integrated rail.

11. The integrated rail of claim 1, characterized in that the block C is configured to be divided by the vertical dividing plane I into the sub-block CI and the sub-block CII from the inside to the outside, wherein the sub-block CI is located at the inner side of the vertical dividing plane I, and the sub-block CII is located at the outer side of the vertical dividing plane I;

a mass of a portion of the block A located at the inner side of the vertical dividing plane I is defined as $M_{A1}$, a mass of a portion of the block A located at the outer side of the vertical dividing plane I is defined as $M_{A2}$, a mass of the block B is defined as $M_B$, a mass of the sub-block CI is defined as $M_{CI}$, and a mass of the subblock CII is defined as $M_{CII}$; and $M_{A1}$, $M_{A2}$, $M_B$, $M_{CI}$ and $M_{CII}$ satisfy the following formula:

$$M_{A1} + M_B + M_{CI} \geq M_{A2} + M_{CII}.$$

12. The integrated rail of claim 1, characterized in that the block C is configured to be divided by the vertical dividing plane I into the sub-block CI and the sub-block CII from the inside to the outside, wherein the sub-block CI is located at the inner side of the vertical dividing plane I, and the sub-block CII is located at the outer side of the vertical dividing plane I;

a mass of a portion of the block A located at the inner side of the vertical dividing plane I is defined as $M_{A1}$, a mass of a portion of the block A located at the outer side of the vertical dividing plane I is defined as $M_{A2}$, a mass of the block B is defined as $M_B$, a mass of the sub-block CI is defined as $M_{CI}$, and a mass of the sub-block CII is defined as $M_{CII}$;

$M_{A1}$, $M_{A2}$, $M_B$, $M_{CI}$ and $M_{CII}$ satisfy the following formula:

$$M_{A1} + M_B + M_{CI} \geq M_{A2} + M_{CII};$$

and the block A extends horizontally outward to the vertical dividing plane I.

13. The integrated rail of claim 1, characterized in that a vertical dividing plane between the block B and the sub-block CI is defined as a vertical dividing plane II, and the outer end of the block A extends horizontally outward to the vertical dividing plane II.

14. The integrated rail of claim 1, characterized in that the block C is configured to be divided by the vertical dividing plane I into the sub-block CI and the sub-block CII from the inside to the outside, wherein the sub-block CI is located at the inner side of the vertical dividing plane I, and the sub-block CII is located at the outer side of the vertical dividing plane I; and the sub-block CII is a top support plate integrally formed on an upper end of an outer side surface of the sub-block CI; and the top support plate extends outward in a horizontal direction, and is configured to support the handrail provided thereon.

15. The integrated rail of claim 1, characterized in that the block C is configured to be divided by the vertical dividing plane I into the sub-block CI and the sub-block CII from the inside to the outside, wherein the sub-block CI is located at the inner side of the vertical dividing plane I, and the sub-block CII is located at the outer side of the vertical dividing plane I;

the sub-block CII comprises a top support plate and a bottom support plate, and the top support plate and the bottom support plate are integrally formed with the sub-block CI;

the top support plate extends outward in a horizontal direction, and is configured to support the handrail provided thereon; and the bottom support plate is arranged below the top support plate and parallel to the top support plate.

16. The integrated rail of claim 15, characterized in that a thickness of the top support plate is greater than that of the bottom support plate.

17. The integrated rail of claim 1, characterized in that the block C is configured to be divided by the vertical dividing plane I into the sub-block CI and the sub-block CII from the inside to the outside, wherein the sub-block CI is located at the inner side of the vertical dividing plane I, and the sub-block CII is located at the outer side of the vertical dividing plane I; and the block C consists of the sub-block CI.

18. The integrated rail of claim 3, characterized in that a top surface of the block A is provided with a top embedding groove.

19. The integrated rail of claim 3, characterized in that the block C is configured to be divided by a vertical dividing plane I into a sub-block CI and a sub-block CII from the inside to the outside, wherein the sub-block CI is located at an inner side of the vertical dividing plane I, and the sub-block CII is located at an outer side of the vertical dividing plane I; and the block C consists of the sub-block CI; and a width of the handrail is greater than that of the sub-block CI.

20. The integrated rail of claim 3, characterized in that the block C is configure to be divided by a vertical dividing plane I into a sub-block CI and a sub-block CII from the inside to the outside, wherein the sub-block CI is located at an inner side of the vertical dividing plane I, and the sub-block CII is located at an outer side of the vertical dividing plane I; and the block C comprises the sub-block CI and the sub-block CII; the sub-block CII is configured as a bottom support plate; an inner side of the bottom support plate is integrally formed with the sub-block CI; and the bottom support plate is spacedly arranged below the block A and parallel to the block A.

21. The integrated rail of claim 3, characterized in that a width of the block A is 12-16 cm.

22. The integrated rail of claim 1, characterized in that an inner side surface of the block B is integrally provided with a protruding structure, which is configured as a support structure for a rubber strip.

23. The integrated rail of claim 11, characterized in that an inner side surface of the block B is integrally provided with a protruding structure, which is configured as a support structure for a rubber strip.

24. The integrated rail of claim 14, characterized in that an inner side surface of the block B is integrally provided with a protruding structure, which is configured as a support structure for a rubber strip.

25. The integrated rail of claim 19, characterized in that an inner side surface of the block B is integrally provided with a protruding structure, which is configured as a support structure for a rubber strip.

26. The integrated rail of claim 22, characterized in that the protruding structure is a support strip extending along a length direction of the integrated rail.

27. The integrated rail of claim 26, characterized in that a height H from a top surface of the support strip to the playing field is calculated by the following formula:

$$H = R(1 + \sin\theta) - Z1;$$

wherein a striking point of a billiard ball on the rubber strip is defined as J, and the striking point is located higher than a center point O of the billiard ball in a vertical direction; R is a radius of the billiard ball; θ is an angle between a line OJ connecting the center point O and the striking point J and the playing field; and Z1 is a vertical distance between the striking point J and the top surface of the support strip.

28. The integrated rail of claim 27, characterized in that a value range of θ is $2° \leq \theta \leq 8°$.

29. The integrated rail of claim 1, characterized in that the block C is configured to be divided by a vertical dividing plane I into a sub-block CI and a sub-block CII from the inside to the outside, wherein the sub-block CI is located at an inner side of the vertical dividing plane I, and the sub-block CII is located at an outer side of the vertical dividing plane I;

the sub-block CI is integrally formed with the block A and the block B to form a main body of the integrated rail; the sub-block CII comprises a top support plate and a bottom support plate; and the bottom surface of the block B is connected to an inner side of the block C to form a right-angled open groove;

the top support plate and the bottom support plate are arranged on an outer side of the main body of the integrated rail, and both extend horizontally outward;

a support strip is provided on an inner side of the main body of the integrated rail for supporting a rubber strip; and the support strip is integrally formed with the main body of the integrated rail, and extends along a length direction of the main body;

the right-angled open groove is arranged at an inner bottom of the main body of the integrated rail, and is formed by perpendicular connection of a horizontal bottom surface of the block B and a vertical surface at an inner side of the sub-block CI; and the horizontal bottom surface of the block B is configured to abut against a top surface of the playing field, and the vertical surface at the inner side of the sub-block CI is configured to abut against an outer side surface of the playing field;

the top support plate and the bottom support plate are arranged in parallel, and the bottom support plate is spacedly arranged below the top support plate; the top support plate and the bottom support plate are both arranged perpendicularly to the main body of the integrated rail; and a decorative plate is provided between the top support plate and the bottom support plate; and a top surface of the main body of the integrated rail is higher than a top surface of the top support plate; and a top of the outer side of the main body of the integrated rail is provided with a step surface A, and is configured to mount the handrail.

30. The integrated rail of claim 29, characterized in that a vertical portion of the step surface A is provided with a top embedding groove along a length direction.

31. The integrated rail of claim 1, characterized in that a plurality of through holes are provided on the sub-block CI along a length direction, and are configured to mount the integrated rail to the playing field.

32. The integrated rail of claim 1, characterized in that the integrated rail has a total width of 12-16 cm and a total height of 9-13 cm.

* * * * *